US010588391B2

(12) United States Patent
Palero et al.

(10) Patent No.: US 10,588,391 B2
(45) Date of Patent: Mar. 17, 2020

(54) HAIR STYLING

(71) Applicant: KONINKLIJKE PHILIPS N.V., Eindhoven (NL)

(72) Inventors: Jonathan Alambra Palero, Eindhoven (NL); Marco Baragona, Eindhoven (NL); Babu Varghese, Eindhoven (NL); Tim Tielemans, Eindhoven (NL); Johan Lub, Eindhoven (NL); Wouter Hendrik Cornelis Spoorendonk, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/083,222

(22) PCT Filed: Feb. 10, 2017

(86) PCT No.: PCT/EP2017/052996

§ 371 (c)(1),
(2) Date: Sep. 7, 2018

(87) PCT Pub. No.: WO2017/153121

PCT Pub. Date: Sep. 14, 2017

(65) Prior Publication Data

US 2019/0343258 A1 Nov. 14, 2019

Related U.S. Application Data

(60) Provisional application No. 62/410,890, filed on Oct. 21, 2016.

(30) Foreign Application Priority Data

Mar. 9, 2016 (EP) ..... 16159472

(51) Int. Cl.
*A45D 1/04* (2006.01)
*A45D 2/00* (2006.01)
*A45D 7/02* (2006.01)

(52) U.S. Cl.
CPC ..... *A45D 1/04* (2013.01); *A45D 2/001* (2013.01); *A45D 7/02* (2013.01); *A45D 2200/205* (2013.01)

(58) Field of Classification Search
CPC . A45D 1/04; A45D 2/001; A45D 7/02; A45D 2200/205
See application file for complete search history.

(56) References Cited

U.S. PATENT DOCUMENTS 5,885,273 A 3/1999 Eckhouse
2001/0013513 A1* 8/2001 Chan ..... A45D 1/04 219/225

(Continued)

FOREIGN PATENT DOCUMENTS

CN 204617356 U 9/2015
FR 2924597 A1 6/2009

(Continued)

*Primary Examiner* — Mary Ellen Bowman

(57) ABSTRACT

In a hair styling device (20), a light emitting diode (33) is configured to deliver optical energy to hair, wherein an energy fluence of the optical energy is between 0.5 and 9 J/cm$^2$, and more preferably between 1 and 5 J/cm$^2$. The light emitting diode (33) is pulse-driven, and a pulse width of the optical energy is at least 50 ms. An output wavelength of the optical energy may be between 400 and 900 nm. The pulse width of the optical energy is preferably between 50 and 300 ms. The hair styling device (20) may comprise an optical shield (32) configured to block stray light during light exposure of the hair. An inner surface of the optical shield (32) may be reflective and/or may have a parabolic shape. The optical shield (32) may be movable between an open position in which a lock of hair can be placed in the hair (Continued)

styling device (20) while the optical energy is not applied, and a closed position in which light is prevented from escaping the hair styling device (20) while the optical energy is applied to the hair. The hair styling device may be a hair straightener having opposing first and second straightening surfaces, of which at least the first straightening surface comprises the light emitting diode (33), and at least the second straightening surface is arranged for reflecting light from the light emitting diode (33).

23 Claims, 2 Drawing Sheets

(56) References Cited

U.S. PATENT DOCUMENTS

| | | | | |
|---|---|---|---|---|
| 2010/0192970 | A1 | 8/2010 | Takahashi | |
| 2012/0060858 | A1* | 3/2012 | Bickford | A45D 4/12 132/211 |
| 2012/0145178 | A1* | 6/2012 | Lombardi | A45D 20/12 132/211 |
| 2016/0051025 | A1 | 2/2016 | Rollat-Corvol | |
| 2016/0067669 | A1* | 3/2016 | Willey | A45D 34/04 422/186.3 |
| 2016/0370113 | A1* | 12/2016 | Valia | A45D 29/00 |

FOREIGN PATENT DOCUMENTS

| | | | |
|---|---|---|---|
| JP | 08-059445 | | 3/1996 |
| JP | H08-071166 | | 3/1996 |
| JP | 10-262725 | | 10/1998 |
| JP | 2012157388 | A | 8/2012 |
| KR | 200436920 | Y1 | 10/2007 |
| WO | 9623447 | A1 | 8/1996 |
| WO | 2004112531 | A1 | 12/2004 |
| WO | 2005079620 | A1 | 9/2005 |
| WO | 2009074957 | A1 | 6/2009 |
| WO | 2009109885 | A1 | 9/2009 |
| WO | 2011060569 | A1 | 5/2011 |
| WO | 2012012050 | A2 | 1/2012 |
| WO | 2013189786 | A1 | 12/2013 |
| WO | 2015070722 | A1 | 5/2015 |
| WO | 2015094839 | A1 | 6/2015 |

* cited by examiner

HAIR STYLING

This application is the U.S. National Phase application under 35 U.S.C. § 371 of International Application No. PCT/EP2017/052996, filed on Feb. 10, 2017, which claims the benefit of U.S. Provisional Application No. 62/410,890 filed Oct. 21, 2016 and International Application No. 16159472.6 filed on Mar. 9, 2016 and. These applications are hereby incorporated by reference herein.

FIELD OF THE INVENTION

The invention relates to hair styling, including hair crimping, curling, perming and straightening.

BACKGROUND OF THE INVENTION

WO 2009/074957 discloses a method of cosmetically treating keratinous fibers made of hair, comprising subjecting the fibers to light pulses that are emitted by a treatment apparatus and that are of duration less than or equal to $5\times10^{-12}$ s. The pulses may have at least one dominant wavelength in any one of the ranges 1000 nm to 1600 nm, 700 nm to 900 nm, 350 nm to 450 nm, and 500 nm to 800 nm. The treatment apparatus may comprise a laser. Depending on the efficiencies, on the pulse durations, and on the hair, the energy density may vary in the range 0.01 J/cm$^2$ to 10 J/cm$^2$. The treatment is a treatment for bleaching hair, it being possible for the hair to have its natural color or to be colored artificially, the bleaching being performed with a view to the hair being dyed so as to be colored differently or with a view to it returning to its natural color. The treatment of the invention can also be used to treat hair for effects other than bleaching, e.g. for transforming the keratin (rearranging or transforming proteins, at the primary, secondary, or tertiary level), with effects, for example, on shape, softness, and/or sheen.

Hair damage, particularly due to the application of heat, is a major concern of consumers. It is therefore highly desired to style the hair without significant heating of the cuticle of hair.

SUMMARY OF THE INVENTION

It is, inter alia, an object of the invention to provide an improved hair styling. The invention is defined by the independent claims. Advantageous embodiments are defined in the dependent claims.

Embodiments of the invention features systems and methods for photo-thermal hair styling, e.g. curling, straightening, by using pulse-driven light emitting diodes (LEDs). Light selectively heats up the cortex of the hair within a narrow range of wavelengths (between 400 and 900 nm, preferably between 400 and 650 nm, and more preferably between 450-550 nm) and within a short period of time (between 50 and 300 ms, preferably between 50 and 200 ms, such as between 100 and 200 ms, or between 50 and 100 ms). In accordance with the invention, an output energy fluence measured on the hair surface is in the range 0.5-9 J/cm$^2$, and preferably 1-5 J/cm$^2$. This prevents heat-induced damage to the cuticle from occurring, and preserves the hair barrier function, and prevent heating of the water content in the hair from occurring, and preserves the moisture content of the hair. Because LED units are small, require low voltage and relatively simple electronic drivers, embodiments of the present invention feature compact, potentially low-cost, safe and cordless (battery-operated) systems.

These and other aspects of the invention will be apparent from and elucidated with reference to the embodiments described hereinafter.

DESCRIPTION OF EMBODIMENTS

Figure 1A:
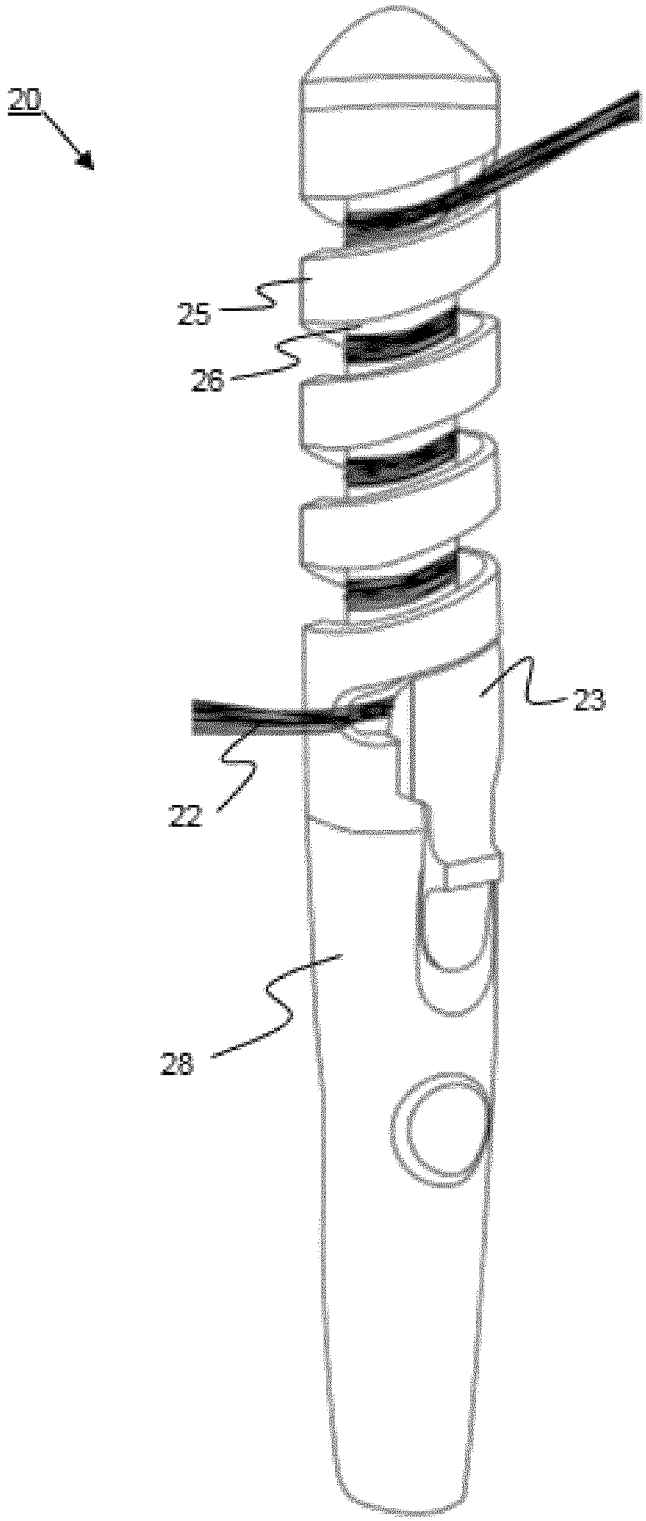
FIGS. 1A and 1B show an embodiment of the invention.

An embodiment of the invention features a handheld hair styling device comprising:

a pulse-driven light emitting diode (LED) or an array of LEDs configured to deliver optical energy to hair, wherein:

- an output wavelength is in the range 400-900 nm, with good results in the range 400-650 nm, and preferably in the range 450-550 nm,
- a pulse width is in the range 50-300 ms, preferably between 50 and 200 ms, such as in the range 100-200 ms, or between 50 and 100 ms,
- an output energy fluence measured on the hair surface is in the range 0.5-9 J/cm$^2$, and preferably 1-5 J/cm$^2$, a LED pulse driver circuit to drive the LED/s, a control system to control the LED pulse driver, particularly controlling pulse electrical parameters including voltage, pulse duration, and pulse duty cycle, a hair contacting interface configured to contact the hair and hold the hair in a pre-configured shape, e.g. planar, cylindrical, during pulsed light exposure provided by the LED, and an optical shield configured to block stray light during light exposure of hair.

A wavelength range preferably between 400 and 900 nm and more preferably between 450 and 550 nm appears to be the optimal wavelength range for selective heating of the cortex. However, high brightness high efficiency LEDs outputting light in the range between 800 nm to 1000 nm may prove to be a direction for more efficient LEDs. Although at such higher wavelengths, melanin absorption is relatively lower than using lower wavelengths, styling by means of such LEDs emitting light in the range between 800 nm to 1000 nm would be more cost-effective than using high power near infrared LEDs.

The pulse width may be to up to 1.5 s or 1500 ms to achieve the required fluence with medium power LEDs, which is especially challenging in the low wavelength range.

A thermal diffusion time constant of hair appears to be between 150 ms and 200 ms.

In an experiment, a lock of brown hair was wound around a metal rod (diameter 15 mm) to an 132-unit array of 650-nm LEDs with energy fluence of 3 J/cm$^2$ with a pulse width of 100 ms. This resulted in a clear curling effect.

Figure 1B:
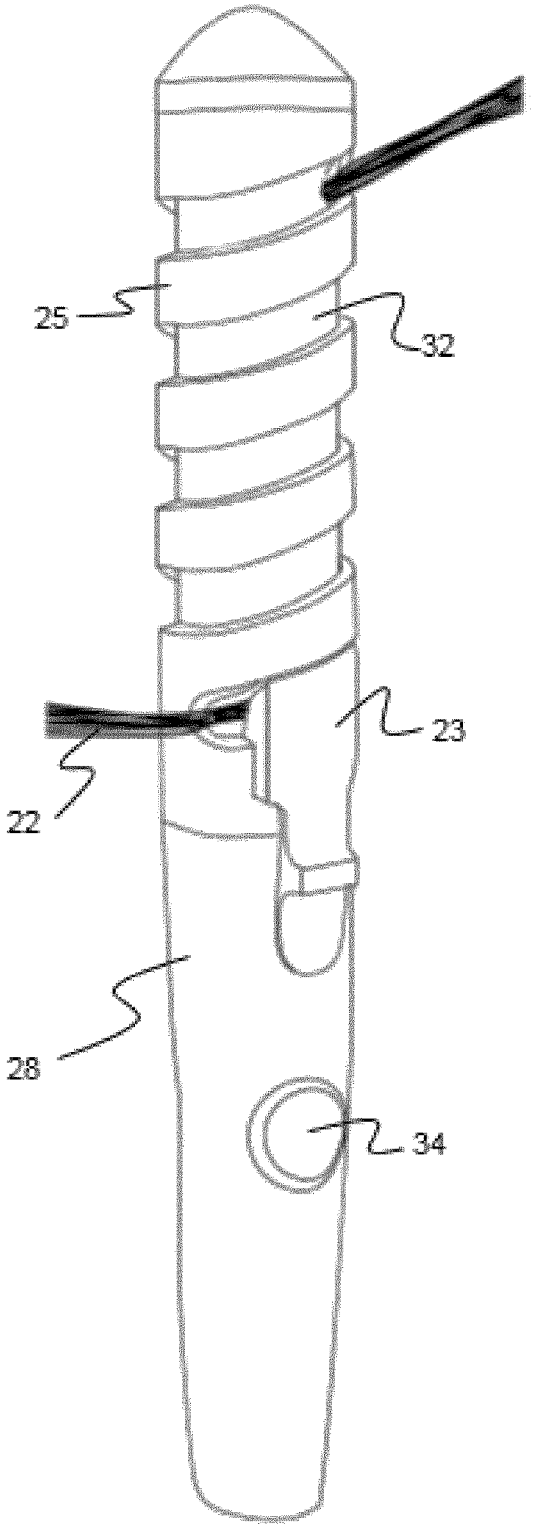

FIGS. 1A and 1B show a handheld hair curler 20 comprising a light exposure unit 26 of essentially cylindrical shape with arrays of light-emitting diodes (LEDs) 33 inside, hair guidance ribs 25 of helical shape, sliding optical shield 32, also of helical shape, and a handle 28.

During use, the first step is the hair placement (FIG. 1A), wherein the end of a hair lock 22 is initially held firmly by a clamp 23 and the rest of the said hair lock is wound or coiled around the light exposure unit 26 guided by the hair guidance ribs 25.

When the hair lock is in place, the enable button 34 can be pressed, and the hair curler 20 first controls the optical shield 32 to slide to the position wherein the region of the hair lock to be exposed to light and the light exposure unit 26 is shielded from view, and then exposure to at least one light pulse provided by the LEDs commences. FIG. 1B shows the curler 20 with closed optical shield 32.

After the light exposure, the optical shield 32 slides back to the open position, and the lock of curled hair 22 can be freely removed from the hair curler by unclamping the clamp 23.

Figure 2:
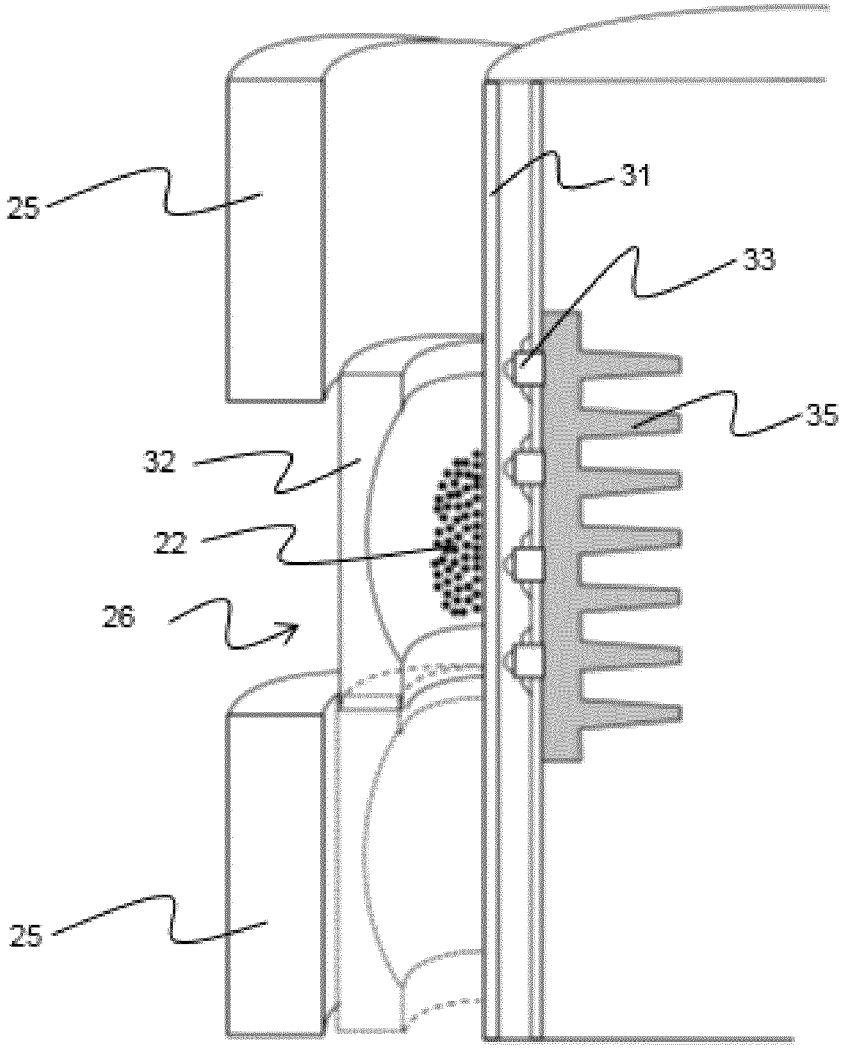
FIG. 2 shows part of the embodiment of FIG. 1 in more detail.

As shown in FIG. 2, the light exposure unit 26 comprise a hair contacting window 31 that allows maximum transmission of light provided by the array of LEDs 33. The LEDs can be cooled passively by heat sink 35. The sliding optical shield 32 is configured to provide maximum recycling of light escaping from the hair lock, for instance by configuring the inner surface to be reflective and configured to have a parabolic shape.

An alternative embodiment may include an optical feedback system e.g. LED light sensor, positioned in the inner surface of the sliding optical shield or in line with the array of LEDs, to sense light, e.g. transmitted and/or reflected light, to provide feedback to the control unit to configure electrical parameters for delivery of light optimized for hair curling. An alternative embodiment could also include a temperature and time sensor to adapt the treatment settings.

Another embodiment of the invention is formed by an LED-based hair straightening device, comprising a clamping mechanism for clamping hair between two surfaces, of which a first surface comprises an LED array and a second surface is reflective. In one implementation of that embodiment, both surfaces of the clamp may comprise LED arrays and reflect light originating from the other surface.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements; using a LED array is thus covered by the claims. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A hair styling device comprising:

a light emitting diode configured to deliver optical energy to hair, wherein an energy fluence of the optical energy is between 0.5 and 9 J/cm$^2$, wherein the light emitting diode is pulse-driven, and a pulse width of the optical energy is at least 50 ms.

2. A hair styling device as claimed in claim 1, wherein an output wavelength of the optical energy is between 400 and 900 nm.

3. A hair styling device as claimed in claim 1, wherein an output wavelength of the optical energy is between 800 and 1000 nm.

4. A hair styling device as claimed in claim 1, wherein the pulse width of the optical energy is between 50 and 300 ms.

5. A hair styling device as claimed in claim 1, further comprising an optical shield configured to block stray light during light exposure of the hair.

6. A hair styling device as claimed in claim 5, wherein an inner surface of the optical shield is reflective.

7. A hair styling device as claimed in claim 5, wherein the inner surface of the optical shield has a parabolic shape.

8. A hair styling device as claimed in claim 5, wherein the optical shield is movable between an open position in which a lock of hair can be placed in the hair styling device while the optical energy is not applied, and a closed position in which light is prevented from escaping the hair styling device while the optical energy is applied to the hair.

9. A hair styling device as claimed in claim 1, wherein the hair styling device is a hair straightener having opposing first and second straightening surfaces, of which at least the first straightening surface comprises the light emitting diode, and at least the second straightening surface is arranged for reflecting light from the light emitting diode.

10. A hair styling method comprising:

delivering optical energy to hair by means of a light emitting diode, wherein an energy fluence of the optical energy is between 0.5 and 9 J/cm$^2$, wherein the optical energy is pulsed, and a pulse width of the optical energy is at least 50 ms.

11. A hair styling method as claimed in claim 10, wherein an output wavelength of the optical energy is between 400 and 900 nm.

12. A hair styling method as claimed in claim 10, wherein an output wavelength of the optical energy is between 800 and 1000 nm.

13. A hair styling method as claimed in claim 10, wherein the pulse width of the optical energy is between 50 and 300 ms.

14. A hair styling device as claimed in claim 1, wherein an energy fluence of the optical energy of the light emitting diode is configured to deliver optical energy to hair between 1 and 5 J/cm$^2$, wherein the light emitting diode is pulse-driven, and a pulse width of the optical energy is at least 50 ms.

15. A hair styling device as claimed in claim 1, wherein an output wavelength of the optical energy is between 400 and 650 nm.

16. A hair styling device as claimed in claim 1, wherein an output wavelength of the optical energy is between 450 and 550 nm.

17. A hair styling device as claimed in claim 1, wherein the pulse width of the optical energy is between 50 and 200 ms.

18. A hair styling device as claimed in claim 1, wherein the pulse width of the optical energy is between 100 and 200 ms.

19. A hair styling method as claimed in claim 10, wherein an energy fluence of the optical energy is between 1 and 5 J/cm$^2$, wherein the optical energy is pulsed, and a pulse width of the optical energy is at least 50 ms.

20. A hair styling method as claimed in claim 10, wherein an output wavelength of the optical energy is between 400 and 650 nm.

21. A hair styling method as claimed in claim 10, wherein an output wavelength of the optical energy is between 450 and 550 nm.

22. A hair styling method as claimed in claim 10, wherein the pulse width of the optical energy is between 50 and 200 ms.

23. A hair styling method as claimed in claim 10, wherein the pulse width of the optical energy is between 100 and 200 ms.

* * * * *